United States Patent [19]

Lee et al.

[11] 4,045,363

[45] Aug. 30, 1977

[54] INVERT EMULSIONS OF IMPROVED EXTREME PRESSURE PROPERTIES

[75] Inventors: Donald A. Lee, Aurora; Philip S. Korosec, Mentor, both of Ohio

[73] Assignee: The Elco Corporation

[21] Appl. No.: 629,763

[22] Filed: Nov. 7, 1975

[51] Int. Cl.[2] ..... C10M 1/06

[52] U.S. Cl. ..... 252/49.5; 252/47.5; 252/48.2

[58] Field of Search ..... 252/47.5, 48.2, 49.5, 252/78

[56] References Cited

U.S. PATENT DOCUMENTS

| | | | |
|---|---|---|---|
| 2,626,240 | 1/1953 | Deutser et al. | 252/49.5 X |
| 3,159,580 | 12/1964 | Hammer et al. | 252/49.5 X |
| 3,177,146 | 4/1965 | Francis | 252/49.5 X |
| 3,255,108 | 6/1966 | Wiese | 252/49.5 X |
| 3,309,316 | 3/1967 | McNinch et al. | 252/47.5 |
| 3,664,955 | 5/1972 | Panzer | 252/47.5 |
| 3,676,346 | 7/1972 | Hu | 252/47.5 |
| 3,939,088 | 2/1976 | Goldschmidt et al. | 252/49.5 X |

FOREIGN PATENT DOCUMENTS

| | | | |
|---|---|---|---|
| 2,243,981 | 3/1973 | Germany | 252/48.2 |

*Primary Examiner*—Delbert E. Gantz
*Assistant Examiner*—Andrew H. Metz
*Attorney, Agent, or Firm*—Paul & Paul

[57] ABSTRACT

Stable water-in-oil invert emulsions suitable for use as fire-resistant lubricants and as fire-resistant hydraulic fluids of improved extreme pressure (E.P.) properties are disclosed. A mixture of polyisobutenyl succinic anhydride, a member selected from the group consisting of a vegetable or animal oil or a mixture thereof, and a mono alpha-unsaturated olefin is sulfurized under heat. The sulfurized mixture is then reacted with a hydrophile on an equivalent basis. This compound is then blended with suitable base stock to form an invert emulsion with improved E.P. and anti-wear properties.

9 Claims, No Drawings

INVERT EMULSIONS OF IMPROVED EXTREME PRESSURE PROPERTIES

BACKGROUND OF THE INVENTION

This invention relates to invert emulsions of improved extreme pressure (E.P.) properties, and more particularly to those used as fire-resistant lubricants and as fire-resistant hydraulic fluids.

Stable water-in-oil invert emulsions for use as lubricants and as fire-resistant hydraulic fluids are known from the prior art; as for example exemplified by U.S. Pat. No. 3,269,946 — Wiese. Also, it is known to sulfurize polyisobutenyl succinic anhydride in order to obtain improved thermal stability; for example as exemplified by U.S. Pat. No. 3,664,955 — Panzer. Other U.S. Patents illustrative of the prior art are 2,965,574 — Tierney; 3,131,150 — Stuart; 3,172,892 — LeSuer; and 2,932,614 — Lynch.

The primary use of invert water-in-oil emulsions has been as fire-resistant lubricating oils, and hydraulic fluids, for use in applications where the hazard of fire was significant. While the invert emulsions substantially reduced the risk of fire from oil or fluid leaks in hazardous applications, such emulsions are not particularly noted for their extreme pressure or anit-wear characteristics and properties.

It remained for the present applicants to provide a stable invert emulsion which also had improved extreme pressure and anti-wear properties.

SUMMARY OF THE INVENTION

Accordingly, it is among the objects of this invention to provide a stable water-in-oil invert emulsion of improved extreme pressure and anit-wear properties, especially adapted for use as fire-resistant lubricating oil and fire-resistant hydraulic fluids.

This and other objects of the invention are obtained with an invert emulsion which contains a co-sulfurized mixture of at least one member selected from the group consisting of an animal and a vegetable oil and a mono alpha-unsaturated olefin.

A mixture of polyisobutenyl succinic anhydride, a member selected from the group consisting of cottonseed oil, jojoba oil, mustard seed oil, sperm oil, lard oil, rapeseed oil, fish oil, crambe oil, linseed oil, soybean oil, corn oil, rice oil, palm oil, peanut oil and mono esters of unsaturated fatty acids, and a mono alpha-unsaturated olefin is sulfurized under heat. The sulfurized mixture is then reacted with a hydrophile such as ammonia, alkyl and aryl amines, polyamines, alcohols and alcholamines on an equivalent basis.

The method utilized to co-sulfurize the mixture is similar to that disclosed in the applicants' prior patent application for sulfurized sperm whale oil substitutes; Ser. No. 236,325, filed Mar. 20, 1972; and Ser. No. 423,205, filed Dec. 10, 1973; the disclosures of both of which are hereby specifically incorporated by reference.

DESCRIPTION OF THE PREFERRED EMBODIMENTS

Essentially, polyisobutenyl succinic anhydride, preferably having a molecular weight of 200 - 1500, is mixed with (1) a member selected from the group consisting of cottonseed oil, soybean oil, corn oil, jojoba oil, mustard seed oil, sperm oil, lard oil, rapeseed oil, fish oil, crambe oil, linseed oil, rice oil, palm oil, peanut oil, and mono esters of unsaturated fatty acids, (2) an alpha-unsaturated mono olefin, and (3) sulfur. The mixture is heated and maintained at from 175° - 200° C until The sulfurization of the mixture is complete. The proportion of each ingredient may be varied, however the normal percentage composition by weight is 40% polyisobutenyl succinic anhydride; 25% vegetable oil or animal oil; 25% of an alpha-unsaturated mono olefin (or mixtures thereof); and 10% elemental sulfur. The sulfur content may vary from 3 - 40 parts by weight.

The sulfurized composition is then reacted with a hydrophilic agent. Examples of such agents are: ammonia, n-butyl amine, ethylene diamine, propylene diamine, diethylene triamine, tetraethylene pentamine, mono-ethanol amine, diethanol amine, propanol amine, dipropanol amine, ethylene glycol, propylene glycol, ethylene oxide, propylene oxide, trimethylolpropane, erythritol, pentaerythriol, sorbitol, manoritol, glycerol and the like.

The hydrophile-reacted composition may be blended with additional extreme pressure and/or anti-wear agents, such as, dialkyldithiophosphates and organic disulfides. Also, emulsion stabilizers may be added; for example, sorbitan mono-oleate, sorbitan tri-oleate, lecitin and the like. The final additive blend is then mixed with suitable oil or fluid at a concentration of from 2 to 10 percent by weight. The oil or fluid blend is then mixed with water in the volume ratio of 60 parts oil or fluid to 40 parts water, in order to form a fire-resistant water-in-oil emulsion.

The following specific examples illustrate particular embodiments of this invention:

EXAMPLE A

Eight hundred grams of commercial grade polyisobutenyl succinic anhydride with an average molecular weight of 518 was mixed with 500 grams of cottonseed oil, 500 grams of $C_{15}$–$C_{20}$ alpha-olefin, and 200 grams of sulfur, making a total of 2,000 grams. The mixture was heated with stirring to 175° C to initiate sulfurization. The mixture was then sulfurized for four (4) hours, cooled to 110° C and then air-blown for two (2) hours at that temperature. Subsequent analysis showed the percentage of sulfur to be 8.4, the viscosity at 210 F to be 150 SUS, and the specific gravity to be 0.9590. The equivalent weight was found to be 226 which was determined by titration with standard KOH solution.

EXAMPLE B

Four hundred grams, 0.154 of a stoichiometric equivalent of the product of Example A, was combined with the stoichiometric equivalent, 16.5 grams, of diethanolamine and 500 ml of xylene. The mixture was refluxed and reacted, and the water removed by azetrope. The amount of water removed was 3.0 ml. The xylene was stripped under vacuum, the reacted mixture was nitrogen-blown for one-half hour, and then the product was cooled.

EXAMPLE C

Four hundred grams, 0.154 of a stoichiometric equivalent of the product of Example A, was combined with the stoichiometric equivalent, 9.5 grams, of tetraethylenepentamine and 500 ml. of xylene. The mixture was refluxed and reacted, and the water was removed by azetrope. The amount of water removed was 2.7 ml. The xylene was stripped under vacuum, the reacted mixture was nitrogen-blown for one-half hour, and then the product was cooled.

EXAMPLE D

Two thousand grams of commercially available polyisobutenyl succinic anhydride with an average molecular weight of 518 was combined with 1,250 grams of cottonseed oil and 1,250 grams of $C_{15}$–$C_{20}$ alpha-olefin. This mixture was heated to 75° C with stirring and then the sulfur added. The mixture was then heated to 170°–175° C. An exotherm occurred which raised the temperature to 185° C. After the exotherm had subsided, the mixture was held at 175° C for 6 hours, cooled to 120°–130° C and air-blown for 4 hours.

Then 206 grams of diethanol-amine in 1 liter of xylene was added to the above product. The amount of water removed was 50 ml. The xylene was stripped under vacuum and the residue (product) analyzed.

Analysis showed the percent sulfur to be 10.0; the viscosity at 210° F was 166.3 SUS; the specific gravity was 0.9513; and the copper strip at 210° F was 1 a-1 b 3 hrs. ASTM D-130.

EXAMPLE E

Four hundred grams of the product from Example A was mixed with 27.3 g of Sorbitol and 500 ml of xylene. The mixture was refluxed and reacted. Water was removed by azetrope. After all the water was removed, the xylene was distilled from the product under vacuum.

EXAMPLE F

Six thousand three hundred grams of polyisobutene with an average molecular weight of 920 was reacted with chlorine gas at 93°–100° C over a 6 hour period. At the end of this period of time the chlorine analysis was 3.5%.

Maleic Anhydride, 650 grams, was added to the above chlorinated material at 95° C. After addition on the maleic anhydride was complete, the mixture was heated to 250° C for 2 hours, and finally nitrogen blown for 2 hours to remove excess or unreacted maleic anhydride. The product was filtered. Equivalent weight was found to be 498.

EXAMPLE G

Two thousand grams of the above product was mixed with 1250 grams of cottonseed oil and 1250 grams of $C_{15}$–$C_{20}$ alpha-olefin. This mixture was heated to 130° C. To this mixture was then added 500 grams of elemental sulfur. The mixture was then heated to 175° C and held for 6 hours. After sulfurization was complete the mixture was air-blown for 6 hours at 110° C. The product had the following analysis: the percent sulfur was found to be 11.08; the viscosity was found to be at 210° F, 428; the specific gravity was 0.9688 and the flash point, COC, ° F, was 425.

EXAMPLE H

To 250 grams of the above product was added 7.56 grams of tetraethylenepentamine. The mixture was heated to 155°–160° C to remove water. A total of 1.8 ml of water was removed. The product was then cooled.

EXAMPLE I

To 250 grams of Example G was added 25.2grams of diethanolamine and 90 grams of toluene. The mixture was stirred and refluxed to remove water. A total of 3.5 ml of water was removed at 150° C.

EXAMPLE J

To 200 g of the product from Example G was added 36 grams of 33% ammonia solution and 150 ml of benzene. The mixture was refluxed and reacted. A total of 28.0 ml of water was removed. Benzene was removed at 90° C under vacuum.

EXAMPLE K

To 200 grams of the product of Example F was added 125 grams of rice oil, 125 grams of $C_{15}$–$C_{20}$ alpha-olefin and 50 grams of elemental sulfur. The mixture was stirred and heated to 175° C and allowed to sulfurize at that temperature for 5 hours. The mixture was then air-blown at 110° C. Analyses of the product showed the percentage of sulfur to be 9.96; and the viscosity at 210° F to be 95.82 cs.

EXAMPLE L

To 200 grams of the product of Example F was added 125 grams of lard oil, 125 grams of $C_{15}$–$C_{18}$ alpha-olefin and 50 grams of sulfur. The mixture was stirred and heated to 175° C and allowed to sulfurize at that temperature for 6 hours. Then the mixture was air-blown at 110° C. Analysis of the product showed the percentage of sulfur to be 10.10; and the viscosity at 210° C to be 75.99 cs.

EXAMPLE M

Two hundred grams of the product of Example F was mixed with 125 grams of corn oil, and 125 grams of $C_{15}$–$C_{20}$ alpha-olefin. The mixture was stirred and heated to 110° C and 50 grams of sulfur was added. The temperature was taken to 175° C and held for 6 hours. After this hold period, the mixture was cooled to 105° C and air-blown for 4 hours. Analysis of the product showed the percentage of sulfur to be 9.39; and the viscosity at 210° C to be 113.97 cs.

EXAMPLE 1

An invert emulsion was prepared containing the following ingredients:

| | |
|---|---|
| Product of Example J | 2.49# |
| ZDTP (Zinc dialkyldithio phosphate derived from $C_3$-$C_6$ alcohols mixture) | 2.49# |
| Sorbitan monoleate | 3.61# |
| Polysorbitan 80 | 0.41# |
| Sulfurized Hydrocarbon | 1.00# |
| Solvent extracted 100/100 oil (Union) | 190 # |
| Water | 155 # |

The first five materials were blended in the base oil until dissolved. Water was added to the oil blend and stirred overnight. An invert emulsion formed as determined by dropping a small amount of the emulsion into a large volume of water which coagulated. An oil-in-water emulsion would have dispersed or dissolved.

EXAMPLE 2

An invert emulsion was prepared containing the following ingredients:

| | |
|---|---|
| Product of Example B | 2.49# |
| ZDTP | 2.49# |
| Sorbitan monoleate | 3.61# |
| Tween 80 | 0.41# |

-continued

| | |
|---|---|
| Sulfurized Hydrocarbon | 1.0 # |
| Solvent extracted 100/100 oil (Union) | 190 # |
| Water | 165 # |

The first five materials were blended in the base oil until dissolved. Water was added to the oil blend and stirred overnight. An invert emulsion formed as determined by previously described test.

EXAMPLE 3

As a point of comparison, an emulsion was prepared following example 15 of U.S. Pat. No. 3,269,946 - Wiese, as follows:

| | |
|---|---|
| Reaction product of 500 m.w.polyisobutylene Succinic Anhydride/Ammonia | 2.00# |
| Solvent extracted neutral 100/100 (Union) | 2.10# |
| Soyabean lechitin | .82# |
| Benzoic Acid/Primeme 81R | .29# |
| Sulfurized Sperm oil | .69# |
| ZDTP (Zinc dialkyldithio phosphate, derived from $C_3$-$C_6$ alcohols mixture) | 4.10# |
| Solvent extracted neutral 100/100 (Union) | 190 # |
| Water | 155 # |

The first six materials were blended in the base oil until dissolved. Water was added to the oil and stirred overnight. An invert emulsion formed as determined by previously described test.

EXAMPLE 4

A commercially available invert emulsion additive was blended at a concentration of 6.0% by wt. in solvent extracted neutral 100/100 oil. The oil blend was mixed with water in a ratio of 60 pts. oil/40 parts water. The emulsion was used as a comparative sample.

The invert emulsions prepared from the above examples 1, 2, 3 and 4 were tested in a Vickers high pressure pump test to determine the wear characteristics.

Table 1 shows the wear data from these tests. The performance of the emulsions of Examples 2 and 3 show clearly the reduced wear obtained using the compositions of our invention as compared to the prior art (Example 4).

Other E.P. tests used to determine the present invention include the Timken tester, Falex tester and Shell four ball tester. Results in Table 1, again, clearly show the superiority of the present invention over prior art.

| EMULSION | | | | |
|---|---|---|---|---|
| Inspection | Ex. 1 | Ex. 2 | Ex. 3 | Ex. 4 |
| Specific Gravity, 60° F. | 0.9208 | 0.9327 | 0.9036 | 0.92 |
| Stablity 210° F/1 hr. (Less than 1% oil separation allowable) | Pass | Pass | Pass | Pass |
| Timken | 25 | 25 | 10 | 0 |
| Shell 4-ball Wear | 0.57 | 0.56 | 0.88 | — |
| Falex, lb. | 2500 | 2250 | 1250 | 1500 |
| Shell 4-ball Weld, kg. | 160 | 160 | 126 | 80 |
| Total Vicker's Pump wt. Loss, mg. | 570.4 | 655.4 | 854.7 | — |
| Inspection | Ex. 1 | Ex. 2 | Ex. 3 | Ex. 4 |
| % Loss Ring | 0.306 | 0.353 | 0.461 | — |
| % Loss Vane | 0.033 | 0.031 | 0.032 | — |

It will be apparent from the above disclosure that various other modifications may be made in the details of constituents, preparation, and resultant product of the invention, and yet still be within the spirit and scope of the present invention as defined in the following claims.

Having thus described our invention, we claim:

1. A stable water-in-oil emulsion, suitable as a fire resistant fluid, comprising 50–80 parts mineral oil, 20–50 parts water and 2–10 parts of the reaction product of (1) the reaction product of sulfur with a mixture of polyisobutenyl succinic anhydride, at least one member selected from the group consisting of animal oil, mono esters of unsaturated fatty acids and vegetable oil, and a mono-alpha-unsaturated olefin and (2) a hydrophile selected from the group consisting of ammonia, alkyl amines, aryl amines, polyamines, alcohols and alcoholamines wherein the reaction product (1) is formed at a temperature within the range of from about 175° to 200° C, and, wherein the reaction product of (1) and (2) is formed at the reflux temperature of the mixture of components (1) and (2).

2. The emulsion of claim 1 wherein the polyisobutenyl succinic anhydride reactant has a molecular weight of from 200–1500.

3. The emulsion of claim 1 wherein cottonseed oil is a reactant.

4. The emulsion of claim 1 wherein rice oil is a reactant.

5. The emulsion of claim 1 wherein a $C_{15-20}$ mono-alpha olefin is a reactant.

6. The emulsion of claim 1 wherein diethanol amine is a reactant.

7. The emulsion of claim 1 wherein tetraethylene pentamine is a reactant.

8. The emulsion of claim 1 wherein ammonia is a reactant.

9. The emulsion of claim 1 wherein sorbital is a reactant.

* * * * *